US005630642A

United States Patent [19]

Grimmett et al.

[11] Patent Number: 5,630,642

[45] Date of Patent: May 20, 1997

[54] CONVENIENCE TABLE FOR FURNITURE

[75] Inventors: Andrew S. Grimmett; Robert O. Giltnane, both of Athens; Laurence A. Nelson, Knoxville, all of Tenn.

[73] Assignee: Plastic Industries, Inc., Athens, Tenn.

[21] Appl. No.: 377,591

[22] Filed: Jan. 24, 1995

[51] Int. Cl.[6] ..... A47B 39/00

[52] U.S. Cl. ..... 297/145; 297/188.14; 297/188.19

[58] Field of Search ..... 297/135, 144, 297/145, 170, 173, 188.01, 188.14, 188.15, 188.16, 188.17, 188.18, 188.19, 188.2, 188.21, 154; 108/139, 140, 6, 10

[56] References Cited

U.S. PATENT DOCUMENTS

| | | | |
|---|---|---|---|
| 358,466 | 3/1887 | Lueders . | |
| 951,145 | 3/1910 | McGenniss . | |
| 975,755 | 11/1910 | Eyles | 297/145 |
| 1,043,638 | 11/1912 | Sneed | 108/140 X |
| 2,053,349 | 9/1936 | Nordmark | 297/116 |
| 2,244,459 | 6/1941 | Jett et al. . | |
| 2,532,953 | 12/1950 | Scott | 297/150 |
| 2,635,678 | 4/1953 | Basil | 297/146 |
| 2,692,806 | 10/1954 | Grace | 108/6 X |
| 2,710,051 | 6/1955 | Greenberg | 297/170 X |
| 2,947,348 | 8/1960 | Peckham . | |
| 3,023,063 | 2/1962 | Hansen | 108/6 X |
| 4,575,149 | 3/1986 | Forestal et al. . | |
| 4,672,898 | 6/1987 | Davidson | 108/6 |
| 4,852,940 | 8/1989 | Kanigowski | 297/145 |
| 4,942,827 | 7/1990 | Norgaard | 297/135 X |
| 4,944,552 | 7/1990 | Harris | 297/145 |
| 5,000,511 | 3/1991 | Shichijo et al. | 297/117 X |
| 5,035,464 | 7/1991 | Spallholtz . | |
| 5,050,929 | 9/1991 | Gueringer et al. | 297/145 |
| 5,271,590 | 12/1993 | Rosen | 297/188.15 X |
| 5,282,671 | 2/1994 | Funk | 297/145 X |
| 5,293,825 | 3/1994 | Cauffiel . | |
| 5,316,369 | 5/1994 | Kanda | 297/135 X |

FOREIGN PATENT DOCUMENTS

| | | | |
|---|---|---|---|
| 494381 | 7/1953 | Canada | 297/144 |

*Primary Examiner*—Milton Nelson, Jr.

*Attorney, Agent, or Firm*—William L. Feeney; Kerkam, Stowell, Kondracki & Clarke, P.C.

[57] ABSTRACT

A table assembly includes a table top and support arm which are stored within an arm rest of a recliner when the table is not in use. When the table is to be used, the support arm pivots up and the table top is connected to the support arm. The table top is rotatable relative to the support arm and any of three holes in the table top can be used to connect the support arm thereto.

18 Claims, 2 Drawing Sheets

FIG.3
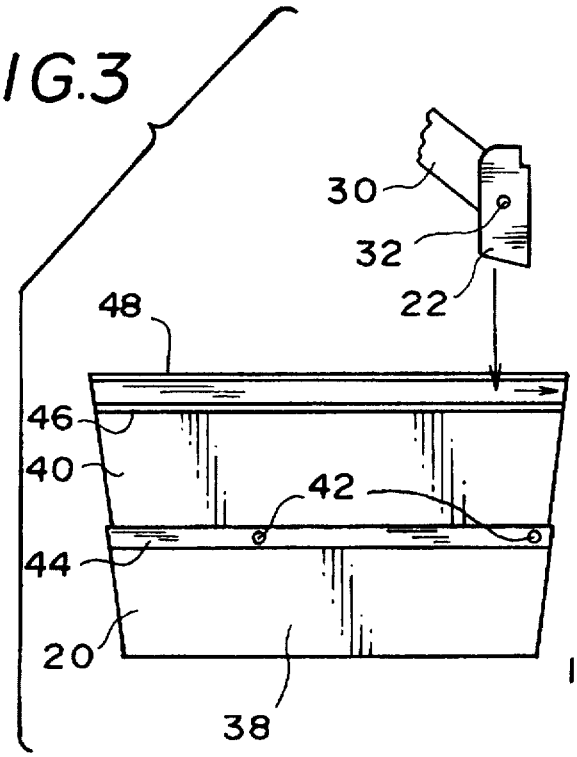
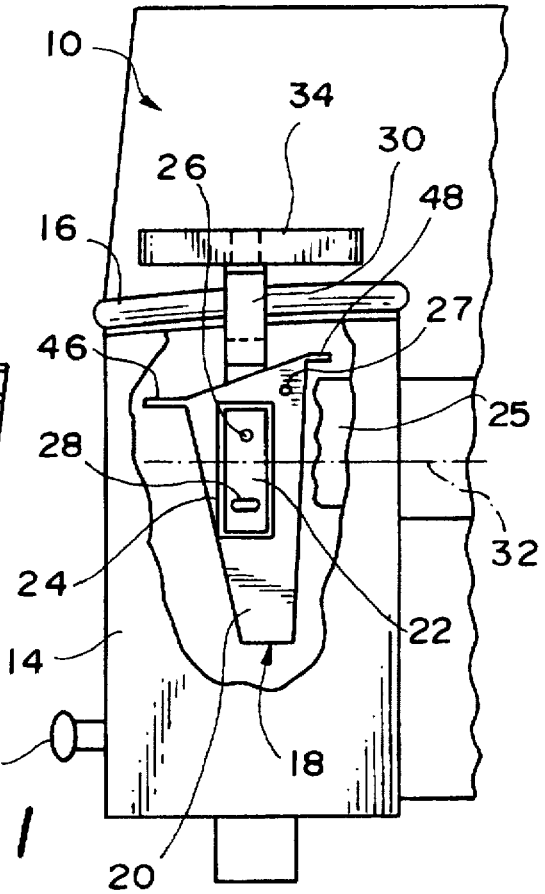
FIG. 1
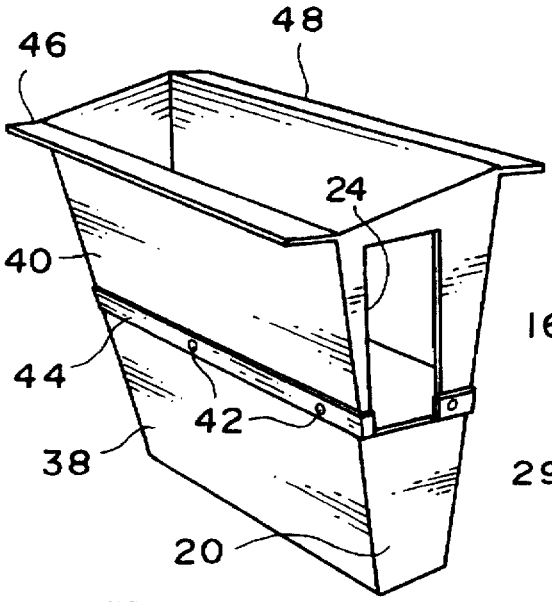
FIG. 4
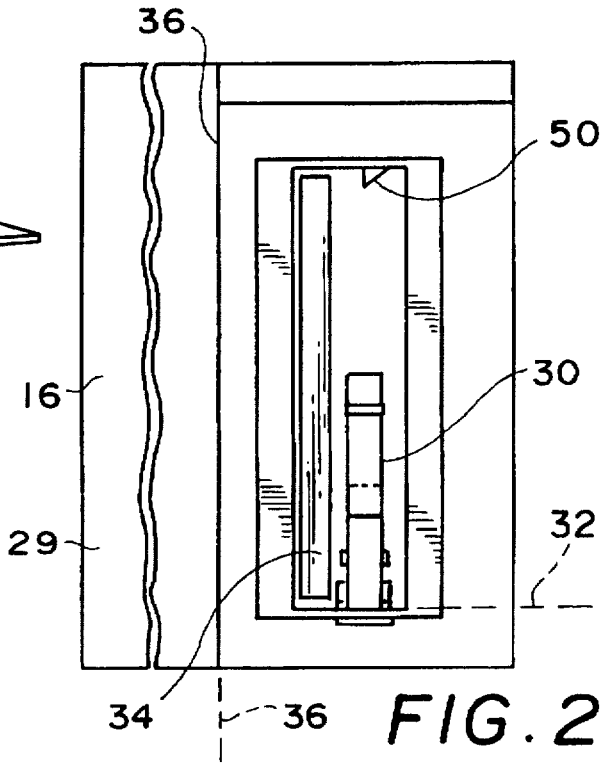
FIG. 2

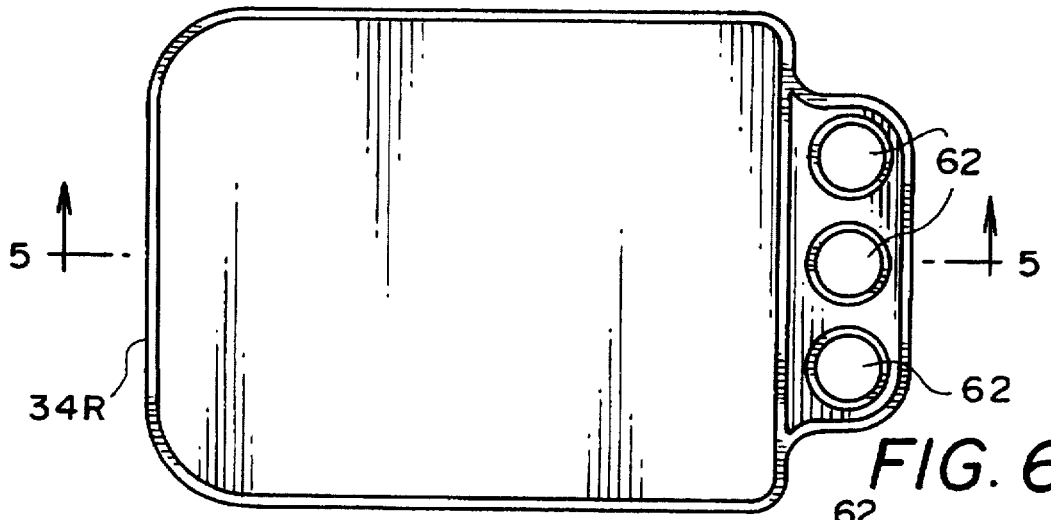
FIG. 6
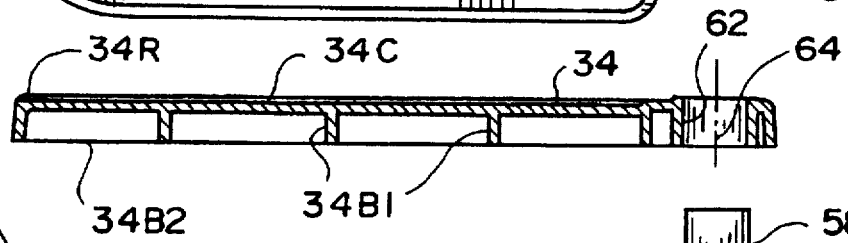
FIG. 5
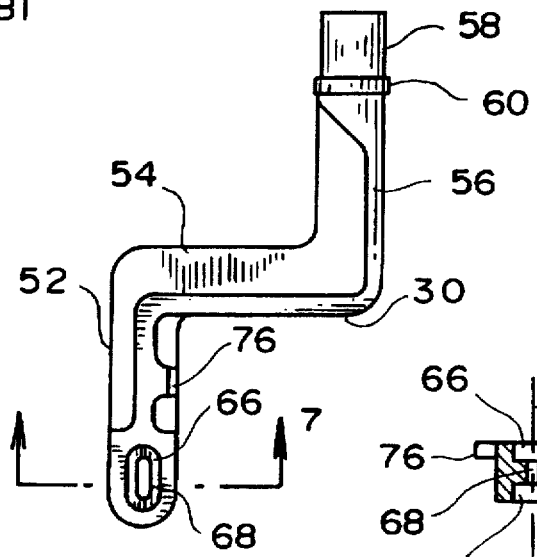
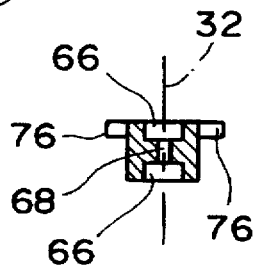
FIG. 7
FIG. 8
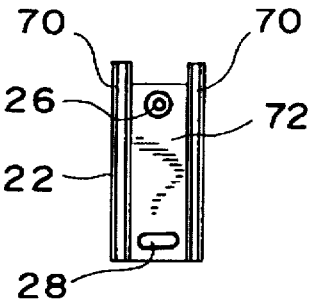
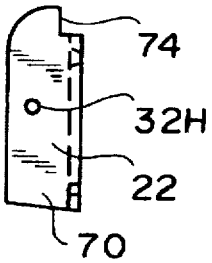
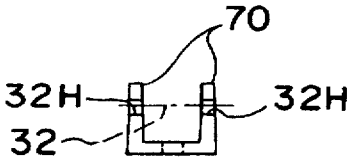
FIG. 9

CONVENIENCE TABLE FOR FURNITURE

BACKGROUND OF THE INVENTION

The present invention relates to a table which fits in an arm of a lounge chair and which may be moved out for use.

Lounge chairs, especially those which recline (called recliners), are quite popular. People often use them for reading, watching television, listening to the radio or music, and generally relaxing. People also sometimes use them for eating, drinking, writing, using a lap top or portable computer, and other activities where a table top would be handy.

Often a tv table or tv tray table is used when eating in a lounge chair. Such a tv table has two pairs of pivoting legs with a top which fastens between two horizontal members. Unfortunately, if the back of the lounge chair is sufficiently deep, one cannot put one's back on the chair back and still reach the tv table unless the tv table is inconveniently placed at the side.

The following patents showing various table and/or chair arrangements are shown:

| U.S. Pat. No. | Inventor | Date Issued |
|---|---|---|
| 358,466 | J. Lueders | March 1, 1887 |
| 951,145 | D. McGenniss | March 8, 1910 |
| 2,244,459 | H. K. Jett et al | June 3, 1941 |
| 2,947,348 | W. L. Peckham | August 2, 1960 |
| 4,575,149 | Forestal et al | March 11, 1986 |
| 5,035,464 | Spallholtz | July 30, 1991 |
| 5,293,825 | Cauffiel | March 15, 1994 |

Lueders shows a chair with an arm rest which converts to a pivoting table.

McGenniss and Jett both show table attachments for chairs such as office chairs or kitchen chairs.

Peckham shows an arm rest with a concealed table unit.

Forestal shows a tray table device which clamps to furniture.

Spallholtz and Cauffiel both show table or tray devices which attach to chairs or sofas.

Although the above and other devices have been generally useful, they are usually subject to one or more of several disadvantages.

Many of such devices or table arrangements are illsuited for use in a lounge chair because the table or tray is not readily accessible if one sits back, especially in a reclined recliner. Some devices interfere with the normal appearance of the chair or sofa. That is, the table and its supports are visible even when the table is not in use and this may detract from the appearance of the furniture. Some such devices require mounting underneath the chair or sofa,in such a way that a chair or sofa with a low underside could not accommodate them. Some such devices do not allow the normal operation of the arm rest when the table is in use.

OBJECTS AND SUMMARY OF THE INVENTION

Accordingly, it is a primary object of the present invention to provide a new and improved convenience table for furniture.

A more specific object of the present invention is to provide a convenience table for furniture which can be used when a recliner is in a reclined position.

A further object of the present invention is to provide a convenience table for furniture which can normally be hidden from view so as to leave the esthetics of the furniture unaffected.

Yet another object of the present invention is to provide a convenience table for furniture which doesn't interfere with the normal functioning of the furniture.

A further object of the present invention is to provide a convenience table for furniture which may be easily positioned in different positions.

Yet another object of the present invention is to provide a convenience table for furniture which is simple in construction and use and relatively low in cost.

Yet another object of the present invention is to provide a convenience table for furniture which minimizes or avoids the disadvantages of prior designs discussed above.

The above and other features of the present invention which will be more readily understood when the following detailed description is considered in conjunction with the accompanying drawings are realized by a table assembly including: an in-furniture storage container; a support arm mounted for movement relative to the storage container between an arm storage position completely within the storage container and an arm use position at least partly outside of the storage container; and a table top disposable in a table storage position completely within the storage container and generally horizontal (i.e., the top surface of the table top is within 20 degrees of horizontal) at least first and second use positions outside of the storage container and in which the table top is supported by the support arm. The table top and the support arm have a different relative position in the first use position than a relative position between the table top and the support arm in the second use position. The support arm would preferably be mounted to the chair frame through a hole in the storage container, but could alternately be mounted to the container itself.

(As used herein, generally horizontal shall mean within 20 degrees of horizontal and generally vertical shall mean within 20 degrees of vertical. However, it is noted that each item described above and/or below as generally horizontal is more preferably within 10 degrees of horizontal and even more preferably horizontal. In similar fashion, it is noted that each item described above and/or below as generally vertically is more preferably within 10 degrees of vertical and even more preferably vertical.)

Preferably, the table top and support arm are unconnected when each is respectively in the table storage position and the arm storage position. The table top includes independent, distinct and offset first and second connection points at which it is connectable to an upper part of the support arm, and wherein the first and second use positions correspond respectively to use of the first and second connection points. Alternately, and/or additionally, each of the connection points is a hole in the table top and the upper part of the support arm is shaped to fit within each hole. Each hole is circular in cross section and the table top is rotatable about a generally vertical axis relative to the support arm.

The storage container has a top perimeter edge and the assembly further includes a hinge, the hinge mounted to a furniture (such as chair or sofa) frame and having the support arm attached to the hinge for pivoting about a generally horizontal pivot axis disposed below the top perimeter edge. Although it is highly preferred to have the hinge mounted to a frame through an opening in the storage container, one could alternately mount the hinge to the storage container itself.

The table top is rotatable about a generally vertical axis relative to the support arm and the first and second use positions of the table top may correspond to the table top being in different rotary positions relative to the support arm.

The support arm is slidable and pivotable relative to the hinge. The hinge and the support arm have cooperating latch mechanisms to latch the support arm in its arm use position. The support arm is slid up relative to the hinge in order to disengage the cooperating latch mechanisms. The cooperating latch mechanisms include a flange and a recess selectively receiving the flange to latch the support arm in its arm use position.

The support arm in its arm use position includes a lower generally vertical portion, a middle generally horizontal portion, and an upper generally vertical portion.

The table assembly is further combined with a piece of sitting furniture (i.e., chair or sofa) having an arm rest and in which the storage container is within and hidden from view by the arm rest. The support arm and table top are hidden from view by the arm rest when respectively in the arm storage position and the table storage position. The sitting furniture may be a lounge chair having an arm cap on the arm rest and the arm cap is rotatable from a capping position about a generally horizontal arm cap axis to an access position for accessing the storage container and wherein the arm cap is disposable in its capping position even with the support arm in its arm use position and table top in either of its first and second use positions.

The present invention may alternately be described as: a hinge adapted for mounting within a piece of sitting furniture; a support arm mounted for movement relative to the storage container between an arm storage position and an arm use position; and a table top disposable in a table storage position and generally horizontal at least first and second use positions and in which the table top is supported by the support arm. The table top and the support arm have a different relative position in the first use position than a relative position between the table top and the support arm in the second use position. The table top is rotatable about a generally vertical axis relative to the support arm and the first and second use positions of the table top correspond to the table top being in different rotary positions relative to the support arm. The support arm in its arm use position includes a lower generally vertical portion, a middle generally horizontal portion, and an upper generally vertical portion. The table assembly may be further combined with a lounge chair having an arm rest and a storage container is within and hidden from view by the arm rest. The arm storage position and table storage position are within the storage container and the support arm and table top are hidden from view by the arm rest when respectively in the arm storage position and the table storage position. An arm cap is on the arm rest and the arm cap is rotatable from a capping position about a generally horizontal arm cap axis to an access position for accessing the storage container and wherein the arm cap is disposable in its capping position even with the support arm in its arm use position and table top in either of its first and second use positions. In a preferred embodiment, the lounge chair is a recliner.

The present invention may alternately be described as a table assembly including: a hinge adapted for mounting within a piece of sitting furniture; a support arm movably mounted to the hinge for pivotable movement about a generally horizontally axis between an arm storage position and an arm use position, the generally horizontal axis extending side to side; and a table top disposable in a table storage position and a generally horizontal first use position and in which the table top is supported by the support arm. The support arm in its arm use position includes a lower generally vertical portion attached to the hinge, a middle generally horizontal portion extending transverse to the side to side horizontal axis, and an upper generally vertical portion.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 1 is a front view of a table assembly in a use position according to the present invention within a recliner chair, shown only in part, and with parts of an arm rest of the chair broken away;

FIG. 2 is a top view of the arm rest with the table assembly therein in a storage position;

FIG. 3 is an exploded side view of a container, hinge, and part of a support arm according to the present invention;

FIG. 4 is a perspective view of the container;

FIG. 5 is an exploded side view of a table top, support arm, and hinge, with the table top in cross section along lines 5—5 of FIG. 6;

FIG. 6 is a top view of the table top;

FIG. 7 is a cross section view of a part of the support arm taken along lines 7—7 of FIG. 5;

FIG. 8 is a front view of the hinge; and

FIG. 9 is a top view of the hinge.

DETAILED DESCRIPTION

FIG. 1 shows a lounge chair 10, more specifically a recliner movable between its upright position shown and an unshown reclined position by use of handle 12. Since the present invention does not rely on the details of the recliner and any of various designs could be used. Indeed, rather than a chair 10, the present invention could be used in other types of sitting furniture such as sofas. An arm rest 14 having an arm cap 16 of cushioning material is constructed at the side of chair 10.

A table assembly 18 includes an in-furniture storage container 20 (i.e., a container adapted for placement within a piece of furniture). Mounted to container 20 is a hinge 22 partially disposed within a rectangular opening 24 in the container. The container 20 may be screwed or bolted (bolts not shown) directly to wood or metal frame members such as 25, shown with portions broken away in FIG. 1 only, within the arm rest 14. Preferably, the container 20 is screw drilled at 27 to the frame member 25 and the opposite end from that visible in FIG. 1 is likewise screw drilled to a frame member. Alternately and/or additionally, the container may be secured within the arm rest 14 by having hinge 22 within the mating opening 24 of container 20 with bolts (not shown) securing bolt hole 26 and bolt slot 28 (slot allows adjustment for proper orientation of the container 20) to wood or metal frame members such as 25 within the arm rest 14.

Pivotably mounted to the hinge 22 is a support arm 30. The support arm 30 pivots about side to side generally horizontal axis 32 from an arm use position (FIG. 1) in which arm 30 extends out of container 20 and an arm storage position (FIG. 2) in which it is disposed within the container 20.

When the arm 30 is in its FIG. 1 arm use position, a table top 34 is in a table use position mounted on an upper portion of the arm 30. When the arm 30 is in its FIG. 2 arm storage position, the table top 34 is in a table storage position (FIG. 2) within the container 20 and it is not connected to the support arm 30. The cap 16 is moved from a capping position (FIG. 1) to an access position (FIG. 2) by pivoting it about a front to back extending sewn pivot axis 36 corresponding to the sewing of outer fabric material of 29 of arm cap 16 to the fabric material of arm rest 14. For ease of illustration, the fabric material is not separately shown, but the arm cap 28 would have such material encasing padding in a well known fashion.

With arm cap 16 in its FIG. 2 access position, the support arm 30 is pivoted about axis 32 from its storage position to its FIG. 1 use position. It will latch in place in a manner described in detail below. The table top 34, which may have already been removed from its FIG. 2 storage position within container 20, may then be snapped onto the support arm 30. The arm cap 16 may be rotated back to its capping position of FIG. 1 such that it cushions even when the table top 34 is being used. Having described the basics of operation of the invention, more details of construction and operation will now be given. The hinge 22, support arm 30, and table top 34 are preferably powder coated aluminum, the powder preferably is plastic. The container 20 is preferably simply made of plastic. Other materials for these components could of course be used.

With reference primarily to FIG. 3, but also considering FIG. 1 and FIG. 2, the container 20 may be molded of a lower piece 38 into which an upper piece 40 is secured by plastic snap fasteners 42 (only two shown but more would be used) on piece 40 extending into corresponding holes (not shown) on a peripheral outer band 44 of piece 38. The upper piece 40 has outside and inside ledges 46 and 48 respectively. Upper piece 40 also has inwardly extending tabs 50 (only top one visible, FIG. 2 only) which help keep the table top 34 from interfering with the retraction of support arm 30 to its storage position.

Considering FIG. 3 and the perspective of FIG. 4, the hinge 22 is placed partially within an opening 24 and thereby mounts the hinge 22 and support arm 30 to the container 20.

Turning now to FIGS. 5, 6, 7, 8, and 9, various construction details will be given. Support arm 30 has in its arm use position a lower generally vertical portion 52 attached to the hinge 22, a middle generally horizontal portion 54 extending transverse to the side to side horizontal axis 32, and an upper generally vertical portion 56 having a generally cylindrical tube (may have slight taper) 58 with annular collar 60 at the bottom thereof.

Tube 58 may fit into any of three independent, distinct and offset connection points corresponding to three identical through holes 62 in table top 34 and the table top 34 will be supported thereby. Although the tube 58 fits snugly within each of the holes 62, it will allow easy rotation of table top 34 relative to the support arm 30 about the generally vertical axis 64 central to whichever of holes 62 the tube 58 is disposed within. The rotation of table top 34 and the positioning of it using any of the three holes 62 provides for numerous different table use positions. That is, the table top 34 can be placed in numerous positions relative to the support arm 30, allowing maximum flexibility in use such as use when the chair 10 (FIG. 1 only) is reclined.

Rim 34R extends around the peripheral of table top 34 to help protect against spilled liquid flowing off the center portion 34C of table top 34. Center portion 34C is preferably a textured table surface to minimize slippage thereon. An array of perpendicular crossing reinforcing ribs 34B1 and 34B2 (FIG. 5 only) are disposed on the underside of table top 34.

Lower portion 52 of arm 30 has opposing oval recessed portions 66 with a through hole slot 68 disposed therein for receiving a bolt (not shown) corresponding to bolt hole 32H (location of axis 32 discussed above).

The hinge 22 has two parallel sides 70 with an end face 72 connecting them. As shown at the bottom part of FIG. 5, each side 70 includes a latch slot 74 into which corresponding latch flanges 76 on arm 30 drop when the arm 30 has been rotated about axis 32 to its use position. Latch slots 74 and latch flanges 76 on arm 30 are cooperating latch mechanisms which secure the arm 30 in place. When one desires to move the arm 30 back to its storage position, one simply lifts the arm 30 (the slot 68 allows movement relative to a bolt in holes 32H) until latch flanges 76 are clear of latch slots 74 and rotates the arm 30 back to its storage position. Before doing so, one would have previously moved arm cap 28 to its access position and used light thumb pressure on the top surface of tube 58, turned table top 34 slightly, and lifted, thereby separating the table top 34 from support arm 30. The table top 34 and support arm 30 are placed in there FIG. 2 positions and the arm cap 16 is rotated back to its capping position of FIG. 1.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and wherein the storage container has a top perimeter edge around an open top, and further comprising a hinge, the hinge having the support arm attached to the binge for pivoting about a generally horizontal pivot axis disposed below the top perimeter edge and wherein the support arm is positioned relative to the storage container such that the support arm pivots out the open top when it is moved from the arm storage position to the arm use position and wherein the table top is positioned for movement out of the open top when moving the table top from its table storage position within the storage container to outside of the storage container; and wherein the table top and support arm are unconnected when each is respectively in the table storage position and the arm storage position.

2. The table assembly of claim 1 wherein the table top includes independent, distinct and offset first and second connection points at which it is connectable to an upper part of the support arm, and wherein the first and second use positions correspond respectively to use of the first and second connection points.

3. The table assembly of claim 1 wherein the table top is rotatable about a generally vertical axis relative to the support arm and the first and second use positions of the table top correspond to the table top being in different rotary positions relative to the support arm.

4. The table assembly of claim 1 wherein the table top includes independent, distinct and offset first and second connection points at which it is connectable to an upper part of the support arm, and wherein the first and second use positions correspond respectively to use of the first and second connection points.

5. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and wherein the table top and support arm are unconnected when each is respectively in the table storage position and the arm storage position; and wherein the table top includes independent, distinct and offset first and second connection points at which it is connectable to an upper part of the support arm, and wherein the first and second use positions correspond respectively to use of the first and second connection points; and wherein each of the connection points is a hole in the table top and the upper part of the support arm is shaped to fit within each hole.

6. The table assembly of claim 5 wherein each hole is circular in cross section and the table top is rotatable about a generally vertical axis relative to the support arm.

7. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and wherein the storage container has a top perimeter edge around an open top, and further comprising a hinge, the hinge having the support arm attached to the hinge for pivoting about a generally horizontal pivot axis disposed below the top perimeter edge and wherein the support arm is positioned relative to the storage container such that the support arm pivots out the open top when it is moved from the arm storage position to the arm use position and wherein the table top is positioned for movement out of the open top when moving the table top from its table storage position within the storage container to outside of the storage container; and wherein the support arm is slidable and pivotable relative to the hinge.

8. The table assembly of claim 7 wherein the hinge and the support arm have cooperating latch mechanisms to latch the support arm in its arm use position.

9. The table assembly of claim 8 wherein the support arm is slid up relative to the hinge in order to disengage the cooperating latch mechanisms.

10. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and further comprising a hinge, the hinge having the support arm attached to the hinge for pivoting about a generally horizontal pivot axis and wherein the support arm is slidable and pivotable relative to the hinge; and wherein the hinge and the support arm have cooperating latch mechanisms to latch the support arm in its arm use position; and wherein the support arm is slid up relative to the hinge in order to disengage the cooperating latch mechanisms; and wherein the cooperating latch mechanisms include a flange and a recess selectively receiving the flange to latch the support arm in its arm use position.

11. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and wherein the storage container has a top perimeter edge around an open top, and further comprising a hinge, the hinge having the support arm attached to the hinge for pivoting about a generally horizontal pivot axis disposed below the top perimeter edge and wherein the support arm is positioned relative to the storage container such that the support arm pivots out the open top when it is moved from the arm storage position to the arm use position and wherein the table top is positioned for movement out of the open top when moving the table top from its table storage position within the storage container to outside of the storage container; and wherein the support arm in its arm use position includes a lower generally vertical portion, a middle generally horizontal portion, and an upper generally vertical portion.

12. A table assembly comprising:.

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and further combined with a piece of sitting furniture having an arm rest and in which the storage container is within and hidden from view by the arm rest, and the support arm and table top are hidden from view by the arm rest when respectively in the arm storage position and the table storage position; and wherein the sitting furniture has an arm cap on the arm rest and the arm cap is rotatable from a capping position about a generally horizontal arm cap axis to an access position for accessing the storage container and wherein the arm cap is disposable in its capping position even with the support arm in its arm use position and table top in either of its first and second use positions.

13. A table assembly comprising:

a storage container for use within a piece of furniture;

a support arm mounted for movement relative to the storage container between an arm storage position completely within the storage container and an arm use position at least partly outside of the storage container; and a table top disposable in a table storage position completely within the storage container and generally horizontal at least first and second use positions outside of the storage container and in which the table top is supported by the support arm, the table top and the support arm having a different relative position in the first use position than a relative position between the table top and the support arm in the second use position; and further combined with a piece of sitting furniture having an arm rest and in which the storage container is within and hidden from view by the arm rest, and the support arm and table top are hidden from view by the arm rest when respectively in the arm storage position and the table storage position; and wherein the sitting furniture is a lounge chair having an arm cap on the arm rest and the arm cap is rotatable from a capping position about a generally horizontal arm cap axis to an access position for accessing the storage container and wherein the arm cap is disposable in its capping position even with the support arm in its arm use position and table top in either of its first and second use positions.

14. A table assembly comprising:

a hinge adapted for mounting within a piece of sitting furniture;

a support arm movably mounted to the hinge for movement between an arm storage position and an arm use position; and a table top disposable in a table storage position and generally horizontal at least first and second use positions and in which the table top is supported by the support arm, the table top and the support arm having a different relative position in the first use position than a relative position between the table top and the support arm in the second use position; and wherein the table top is rotatable about a generally vertical axis relative to the support arm and the first and second use positions of the table top correspond to the table top being in different rotary positions relative to the support arm; and further combined with a piece of sitting furniture having an arm rest and a storage container that is within and hidden from view by the arm rest, and wherein the arm storage position and table storage position are within the storage container and the support arm and table top are hidden from view by the arm rest when respectively in the arm storage position and the table storage position; and further comprising an arm cap on the arm rest and the arm cap is rotatable from a capping position about a generally horizontal arm cap axis to an access position for accessing the storage container and wherein the arm cap is disposable in its capping position even with the support arm in its arm use position and table top in either of its first and second use positions.

15. The table assembly of claim 14 wherein the support arm in its arm use position includes a lower generally vertical portion, a middle generally horizontal portion, and an upper generally vertical portion.

16. The table assembly of claim 14 wherein the piece of sitting furniture is a lounge chair.

17. The table assembly of claim 16 wherein the lounge chair is a recliner.

18. A table assembly comprising:

a hinge adapted for mounting within a piece of sitting furniture;

a support arm movably mounted to the hinge for pivotable movement about a generally horizontal axis between an arm storage position and an arm use position, the generally horizontal axis extending side to side; and a table top disposable in a table storage position and a generally horizontal first use position and in which the table top is supported by the support arm; and wherein the support arm in its arm use position includes a lower generally vertical portion attached to the hinge, a middle generally horizontal portion extending transverse to the side to side horizontal axis, and an upper generally vertical portion; and further comprising a hinge, the hinge having the support arm attached to the hinge for pivoting about the generally horizontal pivot axis and wherein the support arm is slidable and pivotable relative to the hinge; and wherein the hinge and the support arm have cooperating latch mechanisms to latch the support arm in its arm use position; and wherein the support arm is slid up relative to the hinge in order to disengage the cooperating latch mechanisms; and wherein the cooperating latch mechanisms include a flange and a recess selectively receiving the flange to latch the support arm in its arm use position.

* * * * *

UNITED STATES PATENT AND TRADEMARK OFFICE

CERTIFICATE OF CORRECTION

PATENT NO. : 5,630,642

DATED : May 20, 1997

INVENTOR(S) : Andrew S. GRIMMETT; Robert O. GILTNANE; Laurence A. NELSON

It is certified that error appears in the above-indentified patent and that said Letters Patent is hereby corrected as shown below:

Claim 1, line 19, (column 6, line 45), change "binge" to -- hinge --;

Claim 12, line 1 (column 8, line 61) change ":." to -- : --;

Signed and Sealed this

Second Day of September, 1997

*Attest:*

*Attesting Officer*

BRUCE LEHMAN

*Commissioner of Patents and Trademarks*